United States Patent [19]

Brouthers et al.

[11] 4,387,526

[45] Jun. 14, 1983

[54] FIREARM

[75] Inventors: Paul E. Brouthers, Monson; Robert W. MacWilliams, Springfield, both of Mass.

[73] Assignee: D.W.A. Associates, Inc., Monson, Mass.

[21] Appl. No.: 219,903

[22] Filed: Dec. 24, 1980

[51] Int. Cl.[3] ..... F41C 1/00

[52] U.S. Cl. ..... 42/59

[58] Field of Search ..... 42/59

[56] References Cited

U.S. PATENT DOCUMENTS 2,863,248 12/1958 Koucky et al. ..... 42/59
3,136,084 6/1964 Charron ..... 42/59
3,561,319 2/1971 Joyce et al. ..... 42/59
4,253,261 3/1981 Schmidt ..... 42/59

*Primary Examiner*—Charles T. Jordan
*Attorney, Agent, or Firm*—Wolf, Greenfield & Sacks

[57] ABSTRACT

An improved cylinder and barrel configuration permits a reduction in the stress imposed on the throat of a revolver barrel thereby improving the strength and accuracy of the combination. The design employs some degree of sizing of the bullet directly in the cylinder thus permitting the barrel bore to be smaller and decreasing the jump distance from cylinder to barrel. The bullet sizing occurs at a lower velocity and over a greater distance thus providing better accuracy and permitting increased barrel stength.

5 Claims, 3 Drawing Figures

FIREARM

BACKGROUND OF THE INVENTION

The present invention relates in general to firearms and pertains, more particularly, to an improved cylinder and barrel construction adapted to reduce the stress on the throat of a revolver barrel. The improved construction of this invention is characterized by improved strength of the cylinder and barrel configuration along with increased accuracy of the firearm.

In the firearms field, Sporting Arms and Ammunition Manfacturers Institute, Inc. (SAAMI) has standards that recommend certain minimum chamber and barrel parameters corresponding to maximum cartridge parameters. In the firearms industry commercial bullets are typically made of lead or a combination of lead with a thin jacket. When the bullet is fired from the cylinder chamber the bullet tends to increase in size upon exit from the cylinder and is typically resized by the throat of the barrel. In a revolver with multiple chambers in the cylinder, the barrel throat experiences many more pressure cycles than the individual cylinder chambers. In addition to the pressure cycle, the barrel throat is subject to the impact and sizing loads from the passage of the bullet from the cylinder into the throat of the barrel. The problem is further aggravated by the high pressures of Magnum cartridges and the introduction of heavier bullets by handloaders, for example, who use such bullets in silhouette type shooting in which steel plates configured to various animal shapes are to be knocked down at relatively long ranges. Also, in a revolver with heavy recoil characteristics, the reduced cylinder bore prevents the bullet from working forward out of the cartridge case. It is not desirable to have the bullet work forward out of the cartridge case because in doing so it will protrude from the front of the cylinder and prevent continued firing.

Accordingly, one object of the present invention is to provide an improved cylinder and barrel construction of improved strength.

Another object of the present invention is to provide an improved cylinder and barrel construction wherein the bullet is retained within the cylinder until the moment of firing.

Another object of the present invention is to provide an improved cylinder and barrel construction adapted for providing improved accuracy of the firearm.

A further object of the present invention is to provide an improved firearm construction in which the jump distance from the cylinder to the barrel throat is minimized. This has the effect of decreasing the length of travel within which the bullet may increase in size and at the same time also permits an increase in the wall thickness of the barrel.

Another object of the present invention is to provide an improved barrel and cylinder construction characterized by a sizing of the bullet at a lower velocity level during its acceleration causing less bullet deformation.

Still a further object of the present invention is to provide an improved barrel and cylinder construction characterized by improved accuracy and increased barrel strength.

SUMMARY OF THE INVENTION

To accomplish the foregoing and other objects of this invention there is provided a firearm such as a revolver in which the invention resides predominantly in an improved cylinder and barrel construction particularly for reducing stresses on the throat of the revolver barrel and improving the strength and accuracy of the revolver. The concepts of this invention apply in particular to a firearm having a cylinder with multiple cartridge chambers leading to a barrel throat. In accordance with the improvement of this invention, the cartridge chambers are tapered from a larger diameter chamber remote from the barrel to a smaller diameter chamber adjacent the barrel to thereby provide cartridge sizing directly in the cylinder occurring at a lower velocity level during acceleration. This is in distinction to the typical way of bullet sizing which usually occurs only in the barrel throat. Thus in accordance with this invention a thicker wall construction is provided at the forward end of the cylinder to thus size the bullet. This thus allows the throat of the barrel to be smaller thereby decreasing the jump distance from the cylinder to the barrel throat. This has the effect of decreasing the length within which the bullet may increase in size. By not providing all bullet sizing in the barrel, there is thus also an increase in the wall thickness of the barrel. As mentioned previously, the effect of this arrangement is to size the bullet at a lower velocity level during its acceleration, causing less bullet deformation essentially spread over a longer transition period of the bullet as it passes from the cylinder to the barrel throat. This provides increased accuracy and also increased barrel strength, both of which are very desirable attributes in a revolver.

BRIEF DESCRIPTION OF THE DRAWING

Numerous other objects, features and advantages of the invention should now become apparent upon a reading of the following detailed description taken in conjunction with the accompanying drawing, in which.

DETAILED DESCRIPTION

Figure 1:
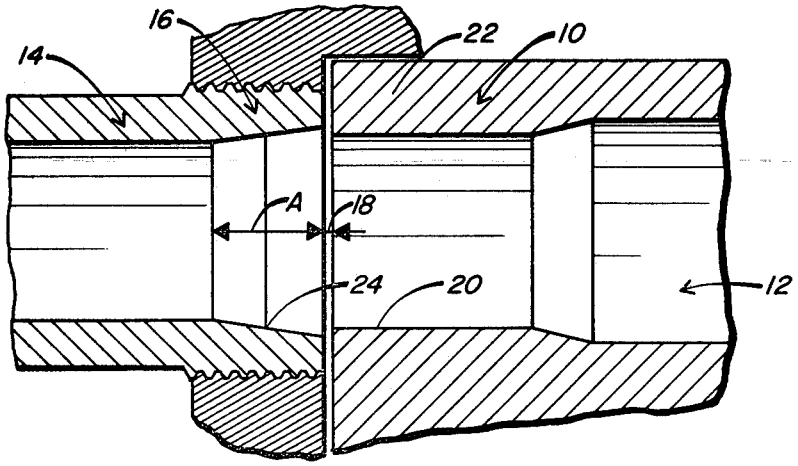
Fig. 1 Prior Art
FIG. 1 is a prior art cross section view showing a standard cylinder and barrel arrangement.
Figure 2:
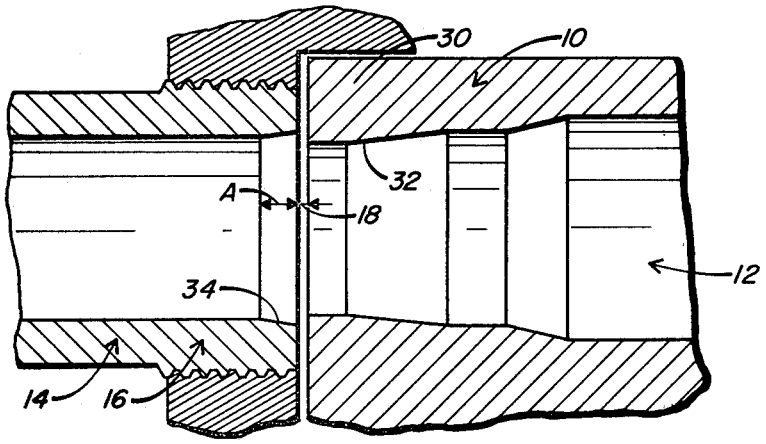
FIG. 2 is a cross-sectional view also taken through the cylinder and barrel of a revolver but embodying the improved principles of this invention.

Both FIGS. 1 and 2 are taken through substantially the same section of a revolver showing a portion of the barrel and a portion of the cylinder. Where applicable, like reference characters will be used to identify in a general sense like parts. Thus, in FIGS. 1 and 2 there is shown a cylinder 10 having one or more cartridge chambers 12 and a barrel 14, in particular showing its throat 16.

FIG. 1 shows the standard construction in which cylinder chamber 12 has a straight bore 20 at its forward end with the wall 22 that defines the bore 20 being of constant thickness. In this arrangement, the straight bore 20 in accordance with standard practice is of a diameter as large or larger than the bullet diameter.

Also, in FIG. 1 in this standard arrangement, the barrel throat is tapered at 24 for the purpose of resizing the bullet. As indicated previously, the bullet tends to expand in and upon leaving the cylinder and thus the thoat is tapered to resize the bullet as it enters the barrel. In the standard construction of FIG. 1, this tapered section defines a "jump distance" identified as distance A.

In connection with the improvement of the present invention reference is now made to FIG. 2 also showing the cylinder 10 with chamber 12, and the barrel 14 with the throat section 16. However, in FIG. 2 the forward wall 30 is internally thickened to provide a tapering of bore 32 of decreasing diameter as the bore extends in the direction of the barrel throat. This tapering of the bore of the cylinder chamber is for the purpose of sizing the bullet directly in the cylinder. This technique enables a decrease in the "jump distance" from the cylinder to the barrel throat as shown by jump distance A in FIG. 2 which is substantially smaller than the jump distance used in a standard arrangement. The tapering of the bore of the cylinder chamber also is for the purpose of retention of the bullet in the cartridge case, particularly in a revolver with heavy recoil characteristics.

Thus, the taper that is used in the barrel throat is much smaller in accordance with the present invention than that shown in FIG. 1. In FIG. 2 this taper is shown at 34. The jump distance is measured from the end of the barrel throat to the end of the taper. It is also noted that because of the decreased taper in the throat, the wall thickness of the throat is maintained of a more uniform thickness. This essentially permits a corresponding increase in the wall thickness of the barrel particularly right at the very throat end thereof.

Accordingly, in accordance with this invention there is provided a sizing of the bullet directly in the cylinder chamber itself enabling a substantial decrease in the "jump distance" from the cylinder to the barrel throat. This has the effect of decreasing the length within which the bullet may increase in size. Because of this decreased jump distance, particularly at the throat end, the wall thickness of the barrel is increased as specified hereinbefore. The effect of the combination is to size the bullet at a lower velocity level during its acceleration, causing less bullet deformation over a longer transition period of the projectile. This provides improved accuracy and increased barrel strength.

Figure 3:
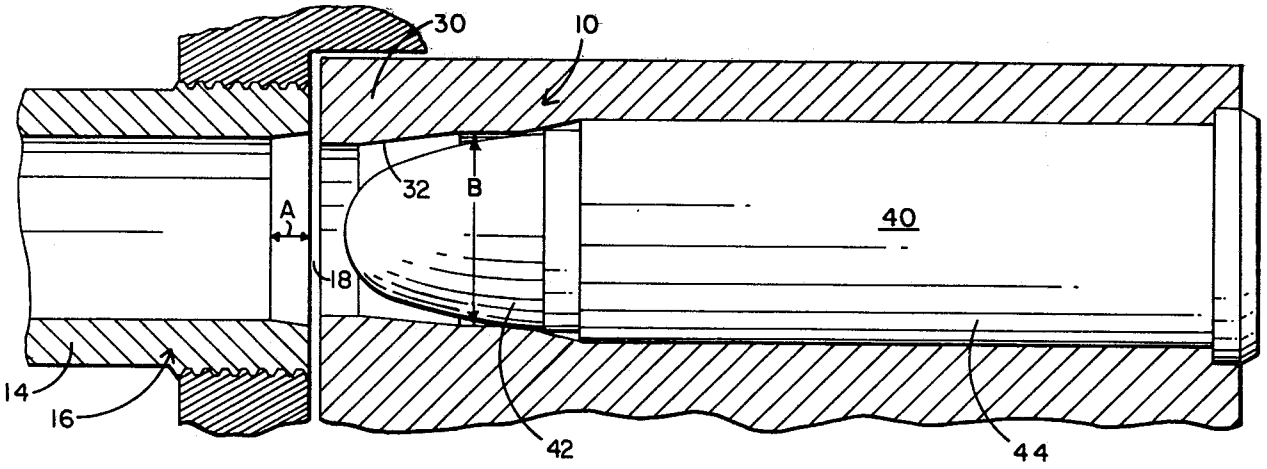
FIG. 3 is a second longitudinal cross-sectional view similar to that disclosed in FIG. 2 but showing a bullet in the cylinder.

FIG. 3 is a cross-sectional view substantially the same as that shown in FIG. 2 showing the tapering bore 32 for resizing of the bullet directly in the cylinder chamber. However, in FIG. 3 there is also shown the cartridge 40 including the bullet 42 and the cartridge case 44. In FIG. 3 the bore diameter at B is adapted to be the same as the maximum bullet diameter (not including, of course, the case), or possibly slightly larger than the maximum bullet diameter. FIG. 3 clearly illustrates that if the cartridge is propelled from the cylinder, there will be a resizing of the bullet or cartridge by the tapered section of the cylinder as the cartridge passes from the cylinder into the barrel. Thus, the bullet is resized to a diameter that is less than the normal diameter of the bullet as it sits in the cylinder prior to firing.

Having described one embodiment of the invention in connection with the revolver, it should now be apparent to those skilled in the art that numerous other embodiments are contemplated as falling within the scope of this invention.

We claim:

1. In a firearm having a cylinder with round chambers leading to a barrel throat, the improvement comprising, said round chambers each having a cartridge accommodating section and a bullet accommodating section with said sections being defined based upon the round being in an unfired rest position in the chamber, said bullet accommodating chamber section including a section tapering from a larger diameter bore remote from the barrel to a smaller diameter bore adjacent the barrel to thereby provide bullet sizing in the cylinder along the tapered bullet accommodating chamber section at a lower velocity level during acceleration than when the bullet is first sized in the barrel, said bullet sizing commencing at a bullet velocity greater than zero with said bullet initially disposed sufficiently rearwardly in the round chamber so as to be out of contact with said tapered bullet accommodating chamber section in the unfired rest position thereof.

2. A firearm as set forth in claim 1 wherein the bullet accommodating section has two separate tapers.

3. A firearm as set forth in claim 1 wherein the barrel bore is tapered a shorter distance than the cartridge chamber to minimize jump distance.

4. A firearm as set forth in claim 1 wherein the tapering of the cartridge chamber enables increased cylinder wall thickness thus providing increased strength and accuracy.

5. A firearm as set forth in claim 1 wherein the minimum tapering in the barrel throat provides increased barrel wall thickness particularly at the throat providing increased strength of the barrel.

* * * * *